United States Patent [19]

Sasseville, Roland E. et al.

[11] 4,435,965

[45] Mar. 13, 1984

[54] APPARATUS FOR TREATING A POROUS, ABSORBENT MATERIAL WITH A FOAMABLE CHEMICAL COMPOSITION

[75] Inventors: Sasseville, Roland E.; Joseph S. Chappell; Daniel J. Corcoran, Jr., all of Greensboro, N.C.

[73] Assignee: Ciba-Geigy Corporation, Ardsley, N.Y.

[21] Appl. No.: 337,856

[22] Filed: Jan. 7, 1982

Related U.S. Application Data

[63] Continuation-in-part of Ser. No. 246,320, Mar. 23, 1981, abandoned.

[51] Int. Cl.[3] ..... D06B 1/06

[52] U.S. Cl. ..... 68/205 R; 118/407

[58] Field of Search ..... 68/200, 205 R; 118/324, 118/325, 407; 8/477; 261/DIG. 26

[56] References Cited

U.S. PATENT DOCUMENTS

| | | | |
|---|---|---|---|
| 3,047,418 | 7/1962 | Compton | 118/324 X |
| 3,953,168 | 4/1976 | Fabbri et al. . | |
| 4,158,076 | 6/1979 | Wallsten . | |
| 4,170,958 | 10/1979 | Moser | 68/205 R X |
| 4,275,683 | 6/1981 | Kutz et al. | 118/407 |

FOREIGN PATENT DOCUMENTS

| | | | |
|---|---|---|---|
| 2359276 | 6/1975 | Fed. Rep. of Germany | 68/200 |
| 2938392 | 4/1981 | Fed. Rep. of Germany . | |
| 2942528 | 4/1981 | Fed. Rep. of Germany . | |
| 2177914 | 11/1973 | France . | |
| 2238008 | 2/1975 | France . | |
| 2283975 | 4/1976 | France . | |
| 2375914 | 7/1978 | France . | |
| 1516882 | 7/1978 | United Kingdom . | |

*Primary Examiner*—Philip R. Coe

*Attorney, Agent, or Firm*—Wenderoth, Lind & Ponack

[57] ABSTRACT

Process and apparatus for treating a porous, absorbent material with a foamable chemical composition, in which a liquid chemical composition that is capable of being foamed, or a porous, absorbent material substrate containing such liquid composition, comes in contact with a porous substance through which air or other inert gas is being forced, to produce an aqueous foam which is used to treat the substrate. The invention eliminates the need for expensive foam generating and applying equipment, and makes it possible for presently employed fabric processing equipment to be inexpensively modified to use aqueous foam treatment for dyeing or other applications.

3 Claims, 7 Drawing Figures

APPARATUS FOR TREATING A POROUS, ABSORBENT MATERIAL WITH A FOAMABLE CHEMICAL COMPOSITION

This application is a continuation-in-part of application Ser. No. 246,320 filed Mar. 23, 1981, and now abandoned.

BACKGROUND OF THE INVENTION

The present invention relates to an apparatus for treating a porous, absorbent material with a foamable chemical composition.

The use of foamed chemical compositions, e.g. dye compositions, to treat various substrates, e.g. carpets, is a relatively new field. Prior to the advent of this type of technology, in conventional processes, e.g. dyeing processes, the fabric to be dyed is immersed in a bath containing the dyestuff and auxiliary components. After allowing sufficient time for the dyestuff to migrate into the fibers forming the fabric, the fabric is removed from the bath, dried, and then treated to fix the dyestuff on the fibers. In such processes, a large amount of water is absorbed from the bath by the fabric, requiring a substantial amount of energy to dry the fabric.

One approach to a solution of this problem has been to employ the chemical compositions in the form of a foam, drastically reducing the amount of water absorbed by the substrate to be treated. However, at present, processes involving aqueous foam generation require expensive machinery to produce foams having the stability which has been thought necessary to obtain satisfactorily treated substrates. Furthermore, in these processes, special applicators are used for depositing the generated foam onto the substrates to be treated.

For example, in general, U.S. Pat. No. 4,023,526 discloses the use of foam applicator heads, comprising a foam distribution chamber, a foam distribution plate, a foam application chamber, and a nozzle to apply the foam to the substrate; U.S. Pat. No. 3,762,860 discloses that the foam should be stable until subjected to elevated temperatures in the presence of a steam atmosphere; U.S. Pat. No. 4,099,913 also discloses that the foam should have sufficient stability to permit it to be pumped from the foam generator to the applicator nozzle; U.S. Pat. No. 4,118,526 indicates that the foam should undergo minimal change during a period from at least about 20 minutes, and up to 24 hours after formation; additional patents which disclose the use of various foamed chemical compositions to treat various substrates are U.S. Pat. No. 3,969,780, U.S. Pat. No. 3,954,404, U.S. Pat. No. 3,990,840 and German Pat. No. 2,713,841.

More specifically, U.S. Pat. No. 4,023,526 discloses a process wherein foam is formed in conventional commercially available foaming means, and conveyed to a foam applicator head. The equipment used to produce the foam is well known and many different types are commercially available. The foam generator usually consists of a mechanical agitator. Air or other gas is used to form the foam. The process can be used to treat textiles, non-woven material, paper, leather or wood.

U.S. Pat. No. 3,762,860 discloses a process wherein air or other gas is introduced into a dyestuff solution to form foam, the foam is applied to a fabric, and the fabric is steamed to break the foam and cause the dyestuff to migrate into the fibers. The air or other gas can be introduced into the dyestuff solution by means of foam generators well known in the art. The gas can be introduced beneath the surface of the solution, or the solution can be agitated and aerated. In the examples of this patent, a milkshake mixer is used to form the foam.

U.S. Pat. No. 3,969,780 discloses a process wherein a dye solution is introduced into a foam machine and mixed therein with air to form a foam. The foam is sent to an applicator means where it is applied to a carpet as the carpet is being advanced beneath the applicator means.

U.S. Pat. No. 4,099,913 discloses converting a treating composition to foam in equipment which is well known and commercially available and which generally consists of a mechanical agitator to mix air and the liquid composition. The foam is conveyed to a foam applicator nozzle where it is transferred to the surface of a textile.

U.S. Pat. No. 3,954,404 discloses a process wherein foam containing a dye is fed to a foam dye box, and a carpet is completely immersed in the foam as it travels through the dye box.

U.S. Pat. No. 4,118,526 discloses a process wherein a liquid composition is converted to foam by conventional procedures, after which the foam is coated onto a fabric. The foam is produced in a mixer, and the foam is then conveyed through a line to the fabric. The patent also discloses that the foam can be conveyed to the fabric by a pump, gravity, or by hand.

U.S. Pat. No. 3,990,840 discloses foaming a liquid dyebath by means of a gaseous propellant. The foam is then applied to a textile, being evenly distributed thereon by means of a doctor knife or a roll.

All of these patents involve the preparation of a foam in some type of enclosed vessel, ad then transferring the foam to the substrate to be treated. This requires the use of expensive foam generating machinery, and the need for chemicals to stabilize the foam.

SUMMARY OF THE INVENTION

It is accordingly a primary object of the present invention to provide an apparatus for treating a porous, absorbent material, as a substrate, with a foamable chemical composition, which avoid the prior art requirements for expensive foam generating and applying machinery, and which can be carried out without the need for ensuring relatively longlasting foam stability.

In this regard, the present invention eliminates the need for expensive foam generating and applying machinery, and makes it possible for presently employed fabric processing equipment to be inexpensively modified to use aqueous foam treatment for dye or other chemical applications. In the present invention, the generating of foam a few seconds, e.g. 1–10 seconds, before it is applied to the substrate, or the generating of foam in or on the substrate itself, simplifies the process, while, for example, in the case of a dyeing process, making it possible to obtain solid shades or achieve multicolored styling effects through the use of collapsible aqueous foams more economically than the presently available methods.

The present invention provides apparatus for performing a process for treating a porous, absorbent material with a foamable chemical composition. One embodiment of this process comprises forming a stream of a liquid, foamable chemical composition containing a modifying compound with which it is desired to treat said material, which chemical composition is capable of being foamed by forcing a gas through said chemical composition; forcing an inert gas through said stream of said chemical composition, before said stream contacts said porous, absorbent material, to form a foam of said chemical composition; and applying said foam to said porous, absorbent material.

A second embodiment of the process comprises providing a liquid, foamable chemical composition containing a modifying compound with which it is desired to treat the porous, absorbent material, which chemical composition is capable of being foamed by forcing a gas through said chemical composition; providing a foaming means having a porous means and gas directing means for directing a gas through said porous means; applying said foamable chemical composition onto said porous means; forcing an inert gas through said porous means and said foamable chemical composition to form a foam of said chemical composition; and applying said foam to said porous, absorbent material.

A third embodiment of the process comprises applying to said porous, absorbent material a liquid, foamable chemical composition containing a modifying compound with which it is desired to treat said material, which chemical composition is capable of being foamed by forcing a gas through said chemical composition; and forcing an inert gas through said applied chemical composition and simultaneously through said porous, absorbent material to form a foam of said chemical composition on said material.

A fourth embodiment of the process comprises providing a liquid, foamable chemical composition containing a modifying compound with which it is desired to treat said material, which chemical composition is capable of being foamed by forcing a gas through said chemical composition; and applying said chemical composition to said porous, absorbent material while simultaneously forcing an inert gas through said material from that side of said material which is opposite the side to which said chemical composition is being applied, thus forming a foam of said chemical composition on said material.

The present invention also provides an apparatus for treating a porous, absorbent material with a liquid, foamable chemical composition containing a modifying compound with which it is desired to threat the material. The apparatus comprises foaming means having a porous means and gas directing means for directing a gas through a layer of the foamable chemical composition; means for forming the foamable chemical composition into a layer and positioning the layer over said foaming means; and foam transfer means for transferring the foamed chemical composition from said foaming means to the material to be treated.

In the first embodiment of this apparatus (FIG. 1), the apparatus comprises a container for containing the foamable chemical composition; rotatable roll means positioned at least partially in said container for transferring the foamable chemical composition out of said container; a doctor blade having a receiving end adjacent the periphery of said roll means for receiving the foamable chemical composition from said roll means, a discharge end below said receiving end for discharging foam onto the material to be treated, and an intermediate porous portion between said receiving and discharge ends and extending across the doctor blade; a gas chamber having an inlet for introducing the gas into said gas chamber, said gas chamber being positioned beneath said doctor blade and having an opening therein opening against said porous portion for directing the gas from said gas chamber through said porous portion; and material feed means for feeding the material to be treated past said discharge end of said doctor blade; whereby the foamable chemical composition is transported by gravity over said receiving end of said doctor blade, thence over said porous portion to cause foaming of the foamable chemical composition by means of gas being expelled from said gas chamber through said porous portion, and thence over said discharge end of said doctor blade and onto the material to be treated.

In the second embodiment of the apparatus (FIG. 4), the apparatus comprises a container for containing the foamable chemical composition; rotatable roll means positioned at least partially in said container for transferring the foamable chemical composition out of said container; a doctor blade having a receiving end adjacent the periphery of said roll means for receiving the foamable chemical composition from said roll means, and a discharge end below said receiving end for discharging the foamable chemical composition onto the material to be treated; material feed means for feeding the material to be treated past said discharge end of said doctor blade; and a gas chamber having a porous portion and an inlet for introducing the gas into said gas chamber, said gas chamber being positioned to receive and support the material to be treated being fed from said feed means and to permit contact between said porous portion of said gas chamber and the material to be treated; whereby the foamable chemical composition is transported by gravity over said doctor blade onto the material to be treated where it is foamed by means of gas being expelled from said gas chamber through said porous portion.

In the third embodiment of the apparatus (FIG. 5), the apparatus comprises a rotatably mounted hollow cylindrical screen; a hollow, porous, roll squeegee rotatably mounted inside said screen and urging said screen downwardly, said squeegee having an inlet for introducing the gas into said squeegee; a supply pipe mounted inside said screen above said squeegee to supply the foamable chemical composition to the outside surface of said squeegee; and positioning means for positioning the material to be treated below said screen, the assembly of said screen, said squeegee and said supply pipe and said positioning means cooperating with each other for moving the material to be treated and said assembly relative to each other. In another aspect of the invention (illustrated by FIG. 6), the apparatus comprises foaming means having a porous means and gas directing means for directing a gas through the foamable chemical composition; means for applying the foamable chemical composition onto said porous means; and foam transfer means for transferring the foamed chemical composition from said foaming means to the material to be treated.

BRIEF DESCRIPTION OF THE DRAWINGS

The present invention will be explained in more detail below, with reference to the accompanying drawings wherein.

DETAILED DESCRIPTION OF THE INVENTION

Figure 1:
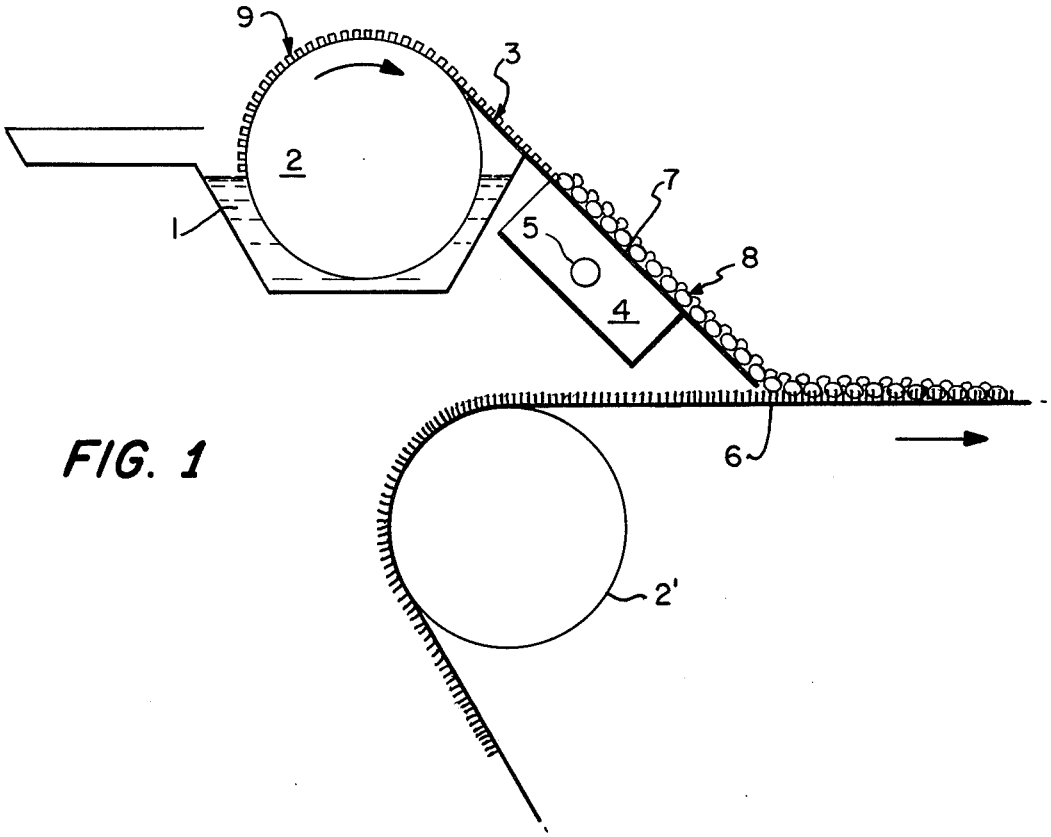
FIG. 1 is a schematic side view of a first embodiment of the apparatus of the present invention.

In accordance with the process of the present invention, a collapsible aqueous foam is generated by passing pressurized air or other inert gas through an aqueous chemical composition, or through a substrate which contains a previously applied aqueous chemical composition, or through a substrate as the aqueous chemical composition strikes the substrate.

The inert gas employed in the present process is any gas which is inert to, i.e. does not react with, the foamable chemical composition or the substrate to be treated. Examples of such inert gases are air, nitrogen, carbon dioxide, and dinitrogen monoxide. Air is preferred.

The substrate may be a fabric such as flat goods, pile fabric, or knitted yarns. The invention is not only applicable to the treatment of textiles, but can also be employed to treat other substrates, such as wood, plastics, paper, etc.

The aqueous chemical composition, which may be colored or uncolored, contains chemicals capable of entrapping air, so that forcing pressurized air through, or injecting it into, the composition will generate a foam. The foam can be generated in or on the substrate itself, or can be generated separately from the substrate and then applied to the substrate within a few seconds. The generated foam, or the aqueous chemical composition to be used in forming the foam, can be deposited onto the substrate to be treated as a single-layered application, a multi-layered application, or a random application, to achieve the desired effects. The pressurized air is conveyed through nozzles, air pipes, glass, etc., and is brought into contact with the aqueous chemical composition through any permeable, porous substance, for example air stones, made of metal, for example sintered metal, woven or non-woven fabric, for example $80^2$ cotton or nylon rip stop cloth, ceramic, or sintered glass, etc. or tubing.

The important feature of each of the embodiments of the process of the present invention is that the foam is formed during the transport of the foamable chemical composition to the substrate to be treated, or is formed in situ on the surface of the substrate. Except for this feature, the process of the present invention can be carried out with the same materials and procedures, and under the same conditions, as employed in prior art processes, insofar as the use of such materials, procedures and conditions is not inconsistent with the present invention.

For instance, the present process is applicable to the treatment of any substrate which has heretofore been treated by prior art processes employing foam, e.g. woven fabrics, non-woven fabrics, pile fabrics and knitted yarns. A specific example of the substrate is a carpet.

Similarly, the foamable chemical compositions which can be used in the present invention can be the same as employed in the prior art. These compositions contain a modifying compound, to impart a desired physical or chemical property to the substrate, a foaming agent, and water. The amounts of the components of the composition are, for example, 0.001–50 weight % of the modifying compound and 0.001–5 weight % of the foaming agent. Where desired, such as in the instance where the foaming agent does not supply sufficient wetting action, the composition may also contain a wetting agent in an amount of, for example, 0.001–5 weight %. All of these weight percentages are based on the total weight of the foamable chemical composition.

The modifying compound is any compound which can be used to impart a desired physical or chemical property to the substrate to be treated. Examples are flame-retarding agents, water-proofing or water-repellant agents, mildew-proofing agents, bacteriostatic agents, antistatic agents, lubricants, whitening agents, and, especially, dyestuffs, pigments and brightening agents. Especially preferred is the use of a dyestuff. Mixtures of two or more of these modifying compounds can also be used.

The particular components to be used in the chemical composition are not important to the present process, so long as the chemical composition is foamable. Numerous examples of these components are set forth in the above-mentioned U.S. Pat. No. 4,023,526.

In general, this foamable chemical composition will have a Brookfield viscosity of 0.5–75 cps at 25° C.

In the first embodiment of the process of the present invention as described above, a stream of the foamable composition is formed. This stream can be a single continuous stream, which can, for example, be produced by the apparatus described hereinafter in connection with FIG. 2, or it can be divided into a pluraity of separate streams, which can, for example, be produced by the apparatus described hereinafter in connection with FIG. 3. Where there are separate streams, the inert gas is forced through each of the separate streams.

For the most part, the foam is formed at a blow ratio of from 2:1 to 100:1, and when formed, the foam will generally have a density of 0.005–0.5 g/cc. The blow ratio is determined by measuring the weight of a given volume of the foam compared by the weight of the same volume of the composition prior to foaming. The foam density can be measured by a procedure as described in U.S. Pat. No. 4,023,526.

The foam is collapsible, and is collapsed after it has been applied to or formed on the substrate to be treated. Generally, the foam collapses upon contact with the substrate or shortly thereafter. The components of the foam are then absorbed into the substrate.

In those cases where it is necessary, heating can be used to facilitate collapse of the foam.

Preferably, the precentage of wet pick-up of the foam is 10–500 weight %, more preferably 50–100 weight %, based on the weight of the substrate to be treated.

After the foam has been collapsed, the substrate can be subjected to conventional post-treatments. One such treatment is to fix the modifying compound on the substrate. This can be done by heating the substrate for a period of time from several seconds to several minutes. For example, in a thermasoling process, the fabric would be heated at a temperature of 250°–425° F., preferably 280°–400° F., for a period of time of from about 10 seconds to about 5 minutes, to fix the dye on the fabric. Steaming can also be employed to fix the modifying compound on the substrate. For example, in a continuous dyeing process for carpets, fixation is achieved by steaming at atmospheric conditions for about 5–20 minutes.

The foam generation step of the present invention comprises bringing a liquid which is capable of being foamed, or a substrate containing such liquid, in contact with a porous substance through which air is being forced, to produce an aqueous foam which is used to treat the substrate. Such foams can be generated with pressures of less than 1 psi, although it is of course apparent that, the higher the density of the porous substance, the greater the air pressure required.

By way of providing a general illustration of the use of the present process for dyeing a carpet, an aqueous dyestuff solution containing a foaming agent, e.g. Cibaphasol AS, is formulated. The pH of the solution is then adjusted for the substrate to be dyed. The solution is then transferred to the applicator on the equipment to be used, described hereinafter in connection with FIG. 1. The delivery rate is adjusted to the wet pick-up desired. The air pressure in the foam generator is set at the psi needed for the porosity being used for air passage. The generated foam is applied to the carpet, after which the carpet proceeds to a steam chamber to fix the dye thereon.

The apparatus for carrying out the process of the present invention will now be described with particular reference to the drawings. The specific embodiment illustrated is for dyeing a carpet, although it is apparent from the foregoing description that the present invention, with regard to both the process and the apparatus, can be used to treat any porous, absorbent material substrate with any foamable chemical composition.

Figure 2:
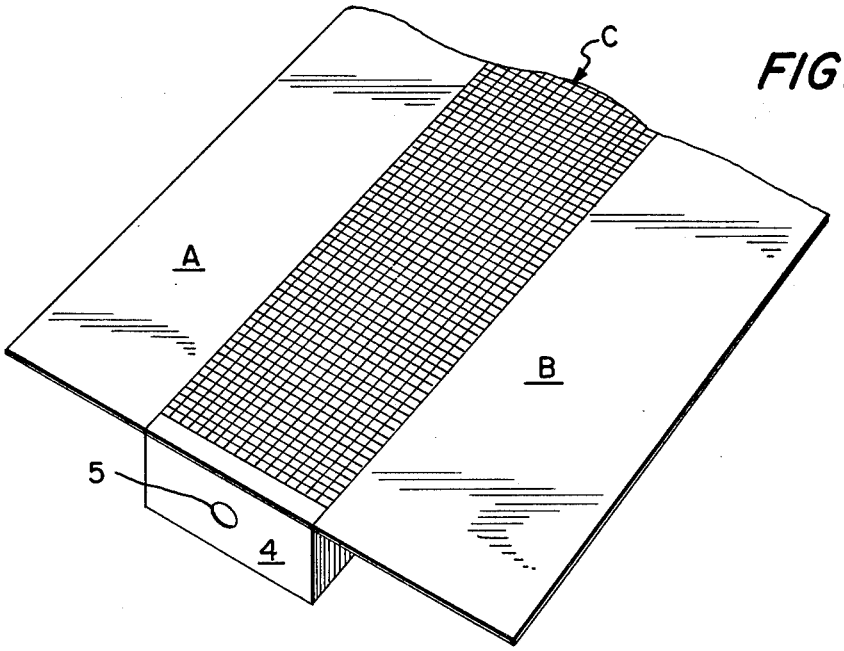
FIG. 2 is a schematic perspective view of a part of a foam-producing doctor blade which can be used in the first embodiment of the apparatus of the present invention.

In FIG. 1, illustrating the first embodiment of the apparatus, a dye liquor container 1 has dye liquor therein, and an applicator roll 2 is rotatably mounted on the apparatus with the periphery passing through the container 1 for picking up a liquid film 9. An inclined doctor blade 3 is positioned to pick up the liquid film 9 from the roll 2. As shown by FIGS. 1 and 2, the doctor blade 3 has a solid entrance portion A, a middle portion C composed of a porous substance 7 and a solid exit portion B. A gas chamber 4 having an intake 5 is mounted on the back of the blade 3 to direct gas through middle portion C.

By way of illustrating the dimensions of the doctor blade in FIG. 2, the entrance portion A can be 4", the middle portion C can be 5" and the exit portion B can be 6" (all measured in the direction of flow of the chemical composition); the gas chamber can be 2" deep; and the length of the doctor blade can be 14'; although other dimensions are acceptable.

As the liquid film 9 comes in contact with the middle portion C of doctor blade 3 it is foamed as a result of gas being forced through the porous substance of middle portion C from within gas chamber 4. The gas pressure within gas chamber 4 is maintained at a sufficient level to produce foam 8 having the desired characteristics. Foam 8 then is transferred, by gravity, off the exit portion B of doctor blade 3. A carpet feed means, only feed roll 2' of which is shown, feeds carpet 6 in the direction of the arrow around feed roll 2' and then under doctor blade 3 in a manner to receive foam 8 from the doctor blade 3.

Figure 3:
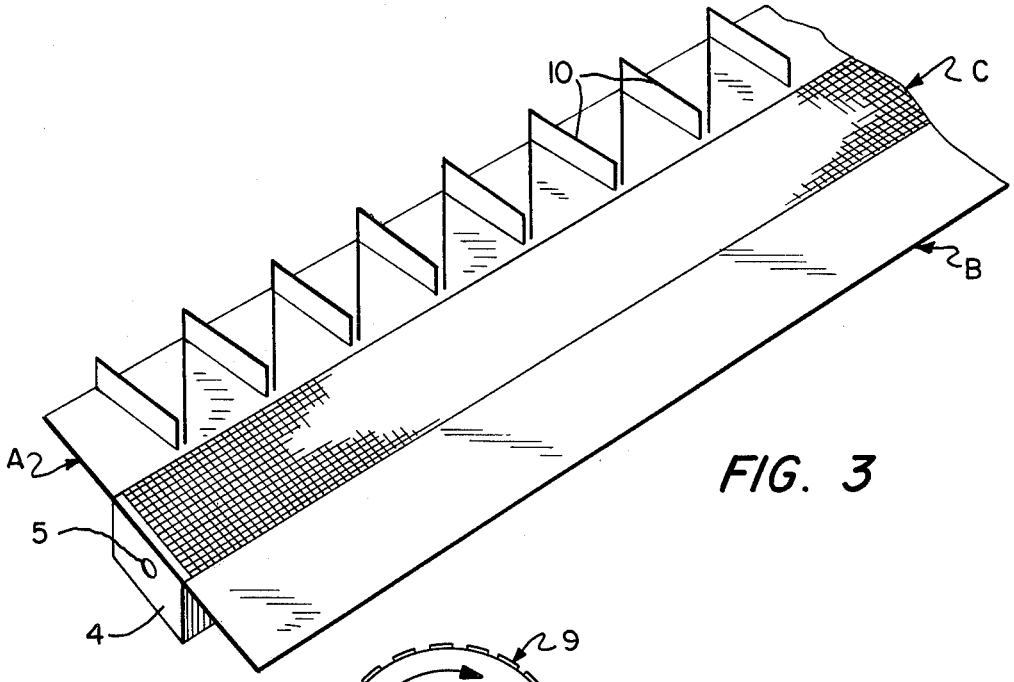
FIG. 3 is a schematic perspective view illustrating a part of a modified foam-producing doctor blade of FIG. 2.

FIG. 3 illustrates a modification of doctor blade 3. In this modification, the entrance portion A of doctor blade 3 is provided with a plurality of elements forming slots through which liquid film 9 is conveyed, by gravity, onto middle portion C of doctor blade 3.

Figure 4:
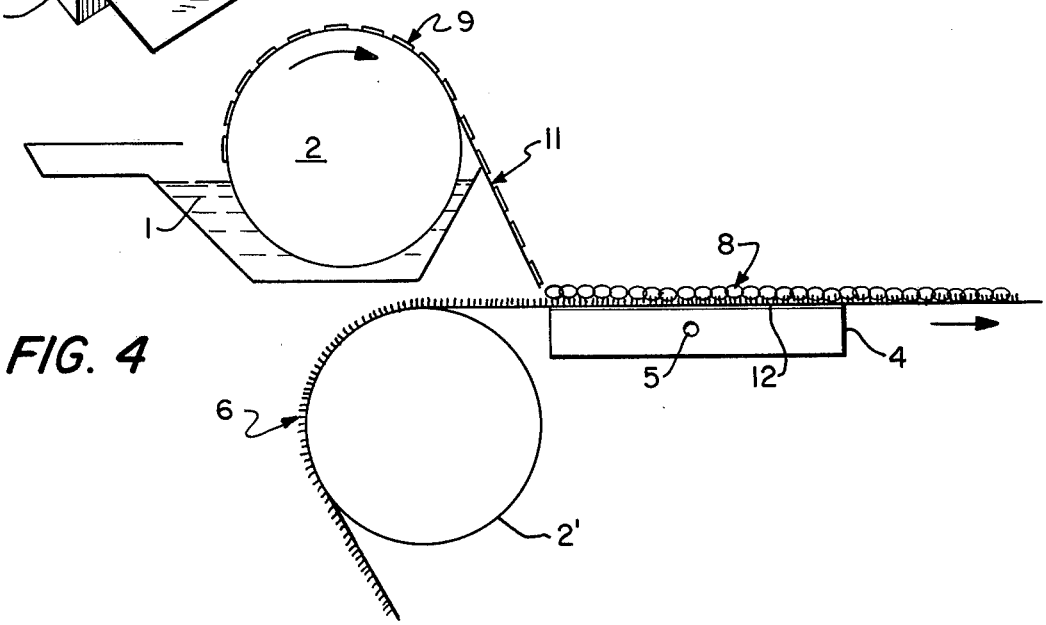
FIG. 4 is a schematic side view of a second embodiment of the apparatus of the present invention.

In FIG. 4, illustrating the second embodiment of the apparatus, liquid film 9 is conveyed, by gravity, across doctor blade 11 onto carpet 6 where it is then foamed by gas being forced through porous substance 12 from within gas chamber 4 supporting carpet 6. In this embodiment, gas, under pressure in gas chamber 4, is forced through porous substance 12 at the underside of carpet 6, and then through carpet 6 to convert liquid film 9 to foam 8 as liquid film 9 strikes carpet 6. Alternatively, liquid film 9 can first be applied to carpet 6 in one operation, after which gas is forced through carpet 6 from its underside to foam the dye liquor.

Figure 5:
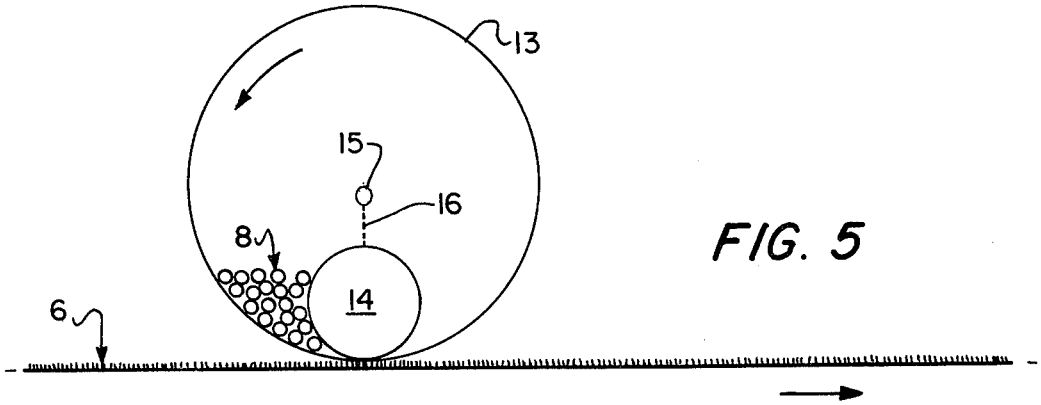
FIG. 5 is a schematic side view of a third embodiment of the apparatus of the present invention.

In FIG. 5, illustrating the third embodiment of the apparatus, cylindrical screen 13 is rotatably mounted on the apparatus and cooperates with squeegee 14 composed of a porous substance rotatably mounted on the apparatus inside screen 13 to urge screen 13 downwardly. Supply pipe 15 is mounted on the apparatus to provide liquid stream 16 onto squeegee 14. This can be accomplished, for example, by numerous perforations on the underside of supply pipe 15 along its entire length. Gas, under pressure within squeegee 14, is forced through the porous substance forming squeegee 14 to produce foam 8 from liquid stream 16. Foam 8 is then forced through rotary screen 13 by the cooperative action of squeegee 14, onto carpet 6 being advanced in the direction shown by the arrow thereunder.

Figure 6:
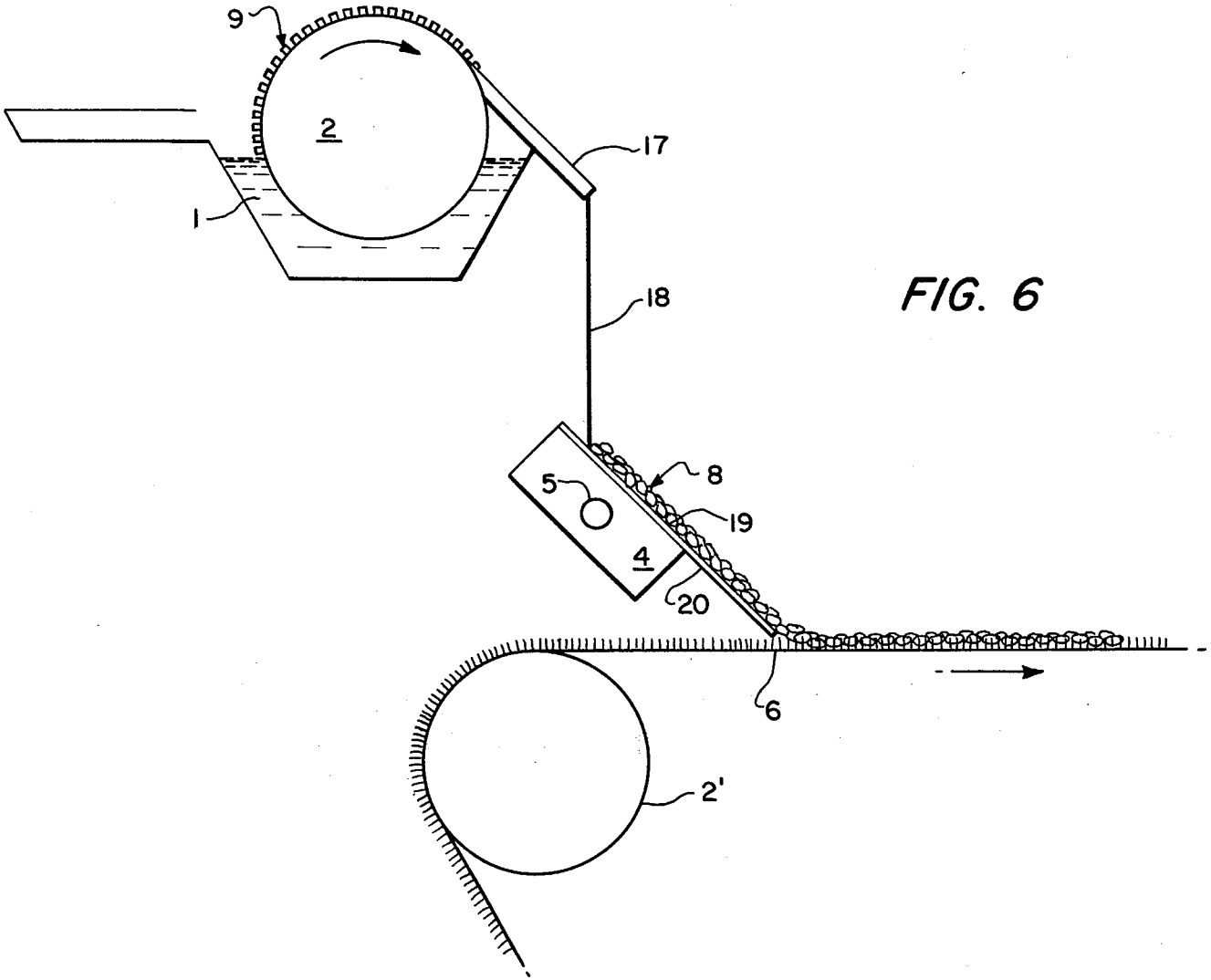
FIGS. 6 and 7 are schematic side views illustrating other aspects of the present invention.

In yet another aspect of the invention, the foamable chemical composition can be applied directly onto the porous means of the foaming means. An illustration of this is shown in FIG. 6, wherein liquid film 9 is picked up from applicator roll 2 by channelled doctor blade 17, forming a plurality of streams 18 of the foamable chemical composition which are applied directly to porous member 19 having extension 20, which can be either porous or nonporous. In this instance, the foaming means can be as illustrated in FIG. 2, but omitting entrance portion A, and, optionally, making exit portion B porous.

Additionally, instead of forming streams 18 in the manner shown in FIG. 6, the foamable chemical composition can be directly applied to the porous means of the foaming means in the form of a jet stream, a spray or mist, or the foamable chemical composition can be metered out from a supply source and transferred by tubes directly onto the porous means of the foaming means.

It is also acceptable to employ a modification of the apparatus of FIG. 6 in which the channelled doctor blade 17 is replaced by a doctor blade of uniform thickness throughout its cross-section, to thus form a sheet or film of the foamable chemical composition which can be directly applied to the porous means of the foaming means.

In a preferred aspect of the invention, the sheet or film, or streams 18, of the foamable chemical composition, is broken up into a discontinuous sheet or film, or streams, prior to applying the composition onto the porous means of the foaming means. An illustration of this is shown in FIG. 7, which also shows one manner in which the present invention can be applied to the multstage treatment of the porous, absorbent material.

Figure 7:
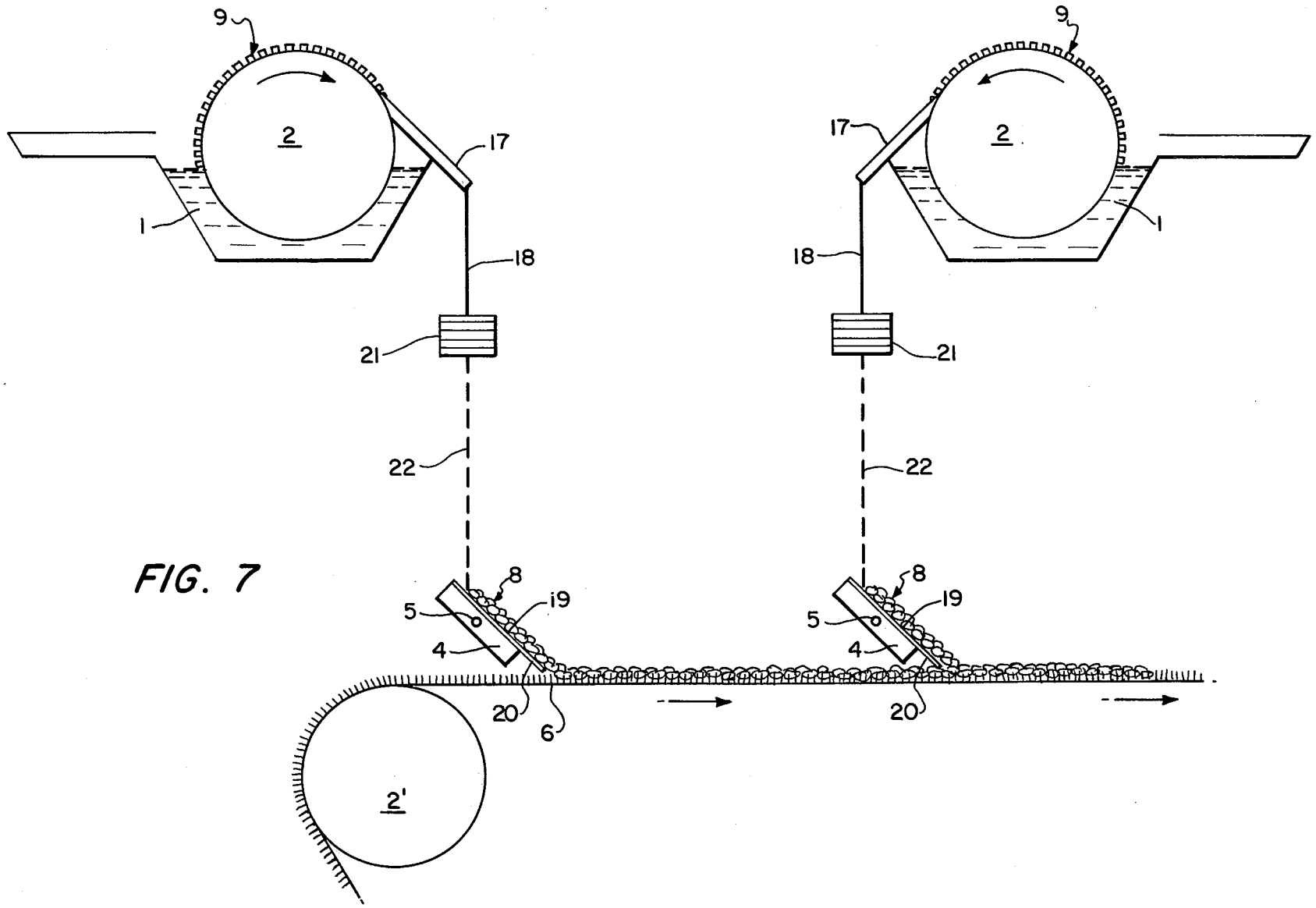

Thus, in FIG. 7, streams 18 formed by channelled doctor blades 17 are broken by drop cutters 21 into discontinuous streams 22 which fall by gravity directly onto porous member 19.

The multi-stage treatment illustrated by FIG. 7 might be used, for example, to apply different dyes to produce different colors on the substrate being treated, and thus create a certain desired styling effect.

In accordance with the present invention, it is possible to evenly treat any porous, absorbent material substrate with any liquid, foamable chemical composition, without the necessity for employing expensive foam generating equipment or expensive equipment to apply the foam.

While preferred embodiments of the present invention have been described, it is apparent that numerous alterations, additions and omissions may be made without departing from the spirit of the invention.

We claim:

1. An apparatus for treating a porous, absorbent material with a liquid, foamable chemical composition containing a modifying compound with which it is desired to treat the material, which chemical composition is capable of being formed by forcing a gas through the chemical composition, said apparatus comprising:

a container for containing the foamable chemical composition;

rotatable roll means positioned at least partially in said container for transferring the foamable chemical composition out of said container;

a doctor blade having a receiving end adjacent the periphery of said roll means for receiving the foamable chemical composition from said roll means, a discharge end below said receiving end for discharging foam onto the material to be treated, and an intermediate porous portion between said receiving and discharge ends and extending across the doctor blade;

a gas chamber having an inlet for introducing the gas into said gas chamber, said gas chamber being positioned beneath said doctor blade and having an opening therein opening against said porous portion for directing the gas from said gas chamber through said porous portion; and material feed means for feeding the material to be treated past said discharge end of said doctor blade;

whereby the foamable chemical composition is transported by gravity over said receiving end of said doctor blade, thence over said porous portion to cause foaming of the foamable chemical composition by means of gas being expelled from said gas chamber through said porous portion, and thence over said discharge end of said doctor blade and onto the material to be treated.

2. An apparatus according to claim 1, wherein said receiving end of said doctor blade is provided with means defining a plurality of slots on said receiving end, to channel separate streams of the foamable chemical composition onto said porous portion of said doctor blade.

3. An apparatus according to claim 1 or 2, wherein said porous portion of said doctor blade is composed of porous metal.

* * * * *